US006737817B2

(12) United States Patent
Yoshinaga

(10) Patent No.: US 6,737,817 B2
(45) Date of Patent: May 18, 2004

(54) CATHODE RAY TUBE APPARATUS

(75) Inventor: Takahiko Yoshinaga, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 168 days.

(21) Appl. No.: 10/008,996

(22) Filed: Dec. 5, 2001

(65) Prior Publication Data

US 2002/0101206 A1 Aug. 1, 2002

(30) Foreign Application Priority Data

Dec. 18, 2000 (JP) ..... 2000-383368

(51) Int. Cl.[7] ..... H01J 29/70
(52) U.S. Cl. ..... 315/364; 313/481
(58) Field of Search ..... 315/399, 364; 313/440, 413, 431, 406, 481

(56) References Cited

U.S. PATENT DOCUMENTS 4,418,365 A * 11/1983 Camras ..... 358/342
4,460,843 A * 7/1984 Ragland, Jr. ..... 313/406
4,614,896 A * 9/1986 Josephs et al. ..... 313/481
5,789,873 A 8/1998 Jeong
5,861,711 A 1/1999 Kim et al.
6,031,327 A * 2/2000 Lee ..... 313/440
6,198,368 B1 * 3/2001 Nam ..... 313/440
6,211,610 B1 4/2001 Nakajima

FOREIGN PATENT DOCUMENTS

JP 2000-77014 3/2000

* cited by examiner

*Primary Examiner*—Don Wong
*Assistant Examiner*—Jimmy T Vu
(74) *Attorney, Agent, or Firm*—Merchant & Gould, P.C.

(57) ABSTRACT

A deflection yoke arranged on an outer part of a funnel of a cathode ray tube includes a holder for housing a ferrite member as a magnetic field correction part for varying a main magnetic field, and the ferrite member is fixed and held by inner walls as resilient members in a housing portion of the holder, thereby holding the ferrite member at the desired position with a simple construction and realizing a cathode ray tube apparatus with reduction of cost and secure convergence correction.

2 Claims, 5 Drawing Sheets

CATHODE RAY TUBE APPARATUS

BACKGROUND OF THE INVENTION

1. Field of the Invention

The present invention relates generally to a cathode ray tube apparatus used in a display monitor and a television receiver. In particular, the present invention relates to a deflection yoke of the cathode ray tube apparatus.

2. Related Background Art

In order to conduct convergence (color convergence onto a screen) of a cathode ray tube apparatus securely, an auxiliary magnetic field correction part typically is provided for a deflection yoke. For example, it is well known to correct misconvergence by using a ferrite member as a magnetic field correction part to vary a main magnetic field. Such misconvergence may include displacement of colors in a horizontal direction in a left and a right region of the screen and in a vertical direction in an upper and a lower region of the screen, which are called "XH" and "YV" respectively.

A ferrite member frequently used as a magnetic field correction part typically is held in a holder member, and then the holder member holding the ferrite member is attached to a deflection yoke. FIG. 6 shows an example of the holder member denoted as "24" and the ferrite member denoted as "25".

However, due to a low dimensional accuracy of ferrite, displacement of the ferrite member is caused easily when the ferrite member is housed in the holder member. This causes difficulties in arranging the ferrite member in a predetermined position in the conventional construction. Consequently, variations in assembly and in performance of convergence correction occur.

At present, reducing the cost of the respective parts constituting a cathode ray tube is required strongly. As a condition for reducing the cost of a deflection yoke, variations in assembly should be avoided. As a matter of course, in order to improve properties of the cathode ray tube such as resolution and color purity, it is preferable that there are no substantial variations in the performance of convergence correction. Thus, a technique for housing ferrite as a correction part in a holder member accurately has been required.

SUMMARY OF THE INVENTION

Therefore, with the foregoing in mind, it is an object of the present invention to provide a cathode ray tube apparatus of simple construction, which includes a magnetic field correction part in a desired position, wherein reduction of cost and secure convergence correction can be realized.

In order to achieve the above object, a cathode ray tube apparatus of the present invention comprises a cathode ray tube comprising an envelope composed of a panel and a funnel, and a deflection yoke arranged on an outer part of the funnel of the cathode ray tube and having a vertical deflection coil and a horizontal deflection coil for generating a main magnetic field, wherein the deflection yoke includes a holder for housing a magnetic field correction part for varying the main magnetic field, and the magnetic field correction part is fixed and held by a resilient member.

Since the magnetic field correction part in the cathode ray tube apparatus is held by means of resilient deformation of the resilient member, the magnetic field correction part can be held securely. Therefore, the cathode ray tube apparatus has a simple construction and includes the magnetic field correction part in the desired position, thereby reducing cost and correcting convergence securely.

In the cathode ray tube apparatus of the present invention, it is preferable that the holder comprises a support member for supporting the resilient member.

According to this, the resiliently deformed resilient member is supported by the support member, so that the strength of the resilient member can be improved.

DETAILED DESCRIPTION OF THE INVENTION

Hereinafter, the present invention will be described by way of an illustrative embodiment with reference to the drawings.

Figure 2:
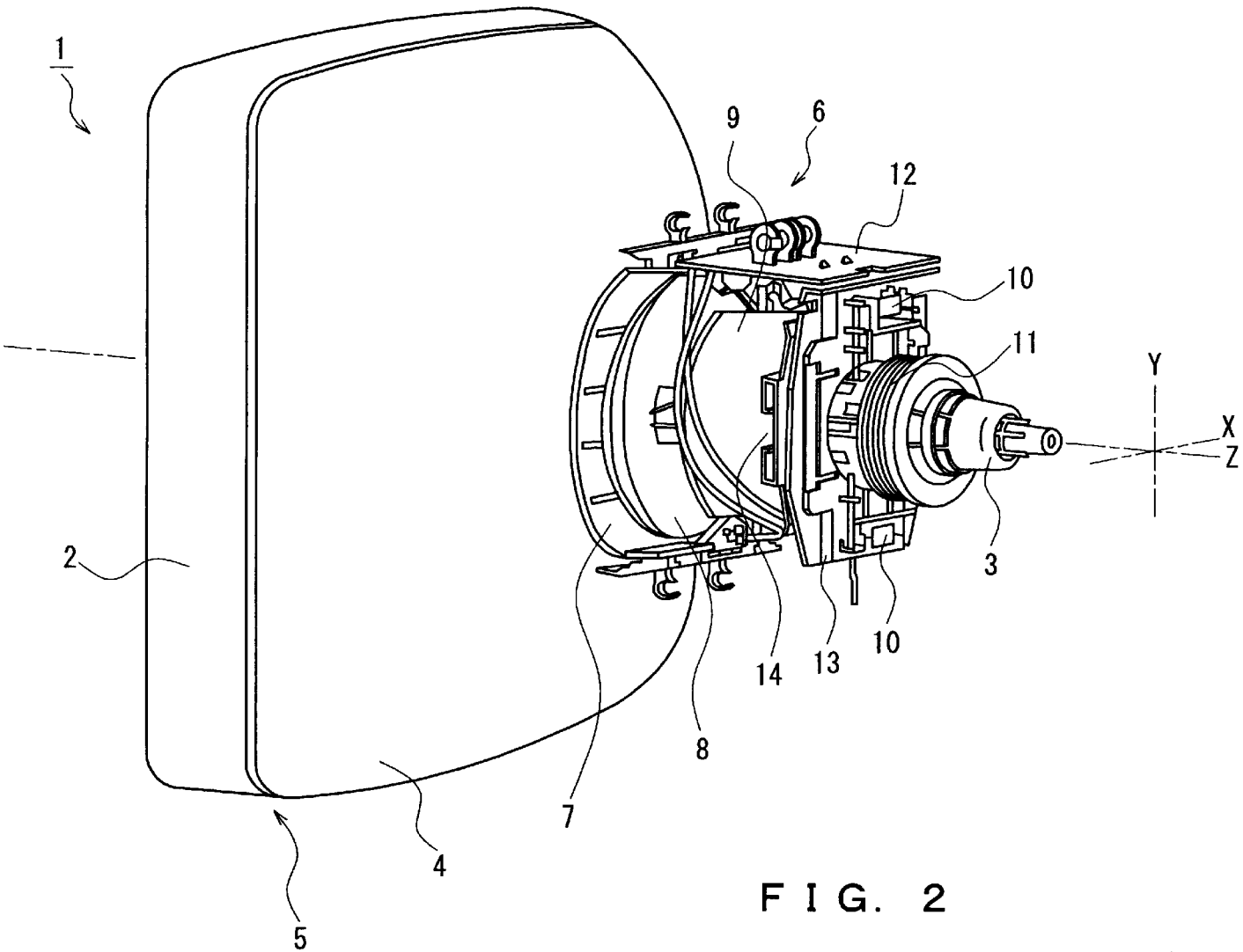
FIG. 2 is an external view of a cathode ray tube apparatus of an embodiment according to the present invention.

FIG. 2 is an external view of a cathode ray tube apparatus of an embodiment according to the present invention. A cathode ray tube apparatus 1 includes a cathode ray tube 5 and a deflection yoke 6. The cathode ray tube 5 comprises an envelope composed of a panel 2 having a phosphor screen internally and a funnel 4 having an electron gun inside a neck portion 3. The deflection yoke 6 is provided at a part of the neck portion 3 of the funnel 4 in order to deflect electron beams emitted from the electron gun on substantially the entire surface of the phosphor screen by distribution of a magnetic field.

The deflection yoke 6 comprises a wound horizontal deflection coil (not shown) inside an insulating frame 7, a wound vertical deflection coil 8 outside the insulating frame 7, a ferrite core 9 arranged on an outer side of the vertical deflection coil 8, and a holder 13. The holder 13 is provided on a rear part of the insulating frame 7 (on an opposite side of the insulating frame 7 to the panel 2 in a direction of a tube axis Z when the insulating frame 7 is attached to the cathode ray tube) and holds a coma-aberration correcting coil 10 as an auxiliary coil, a convergence yoke 11, a terminal board 12 and the like.

Figure 3:
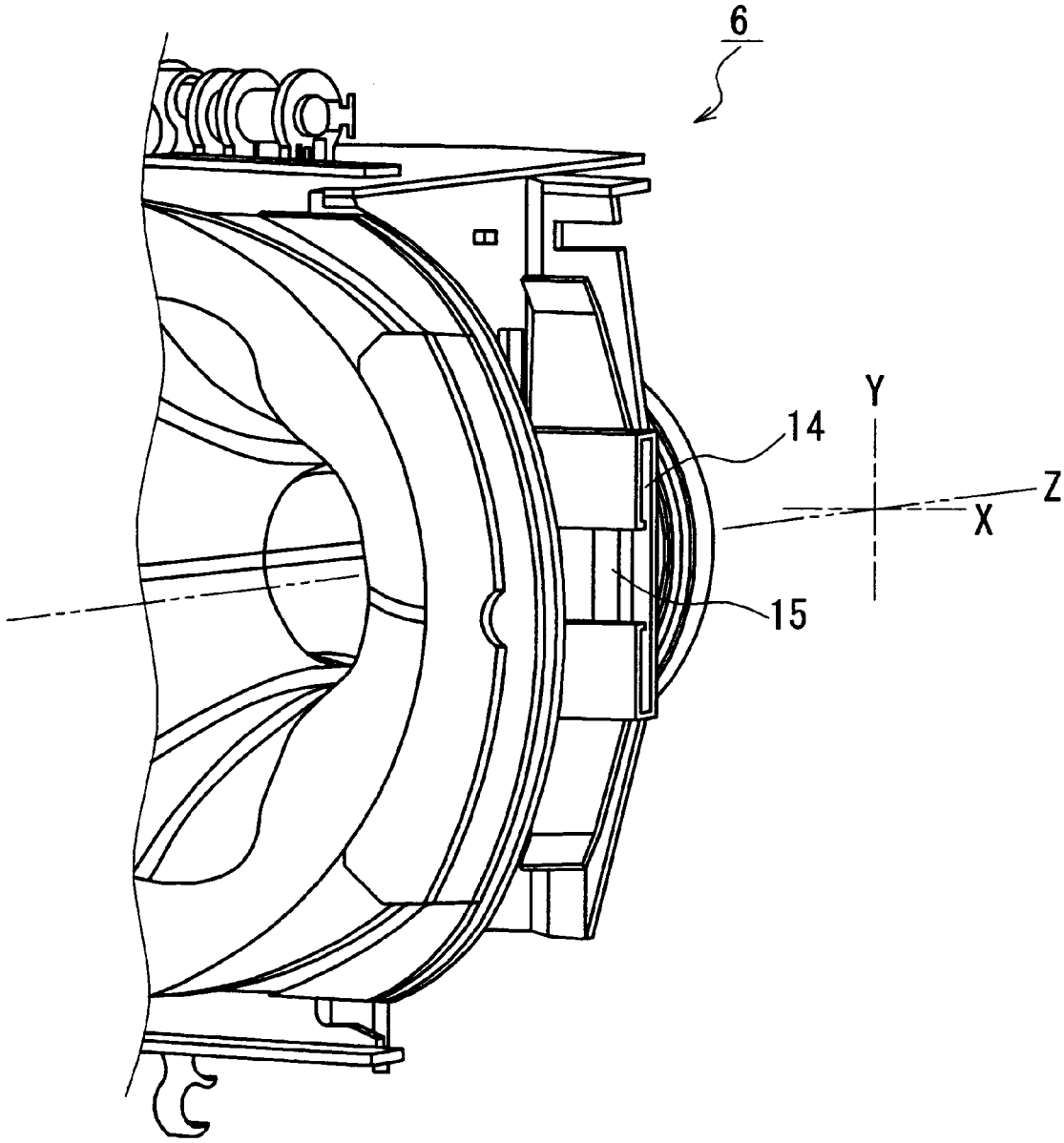
FIG. 3 is a partially perspective view of a deflection yoke of an embodiment according to the present invention, when viewed from a part of a panel.

Housing portions 14 are provided on the front side of the holder 13 (on a side of the holder 13 near to the panel 2 in a direction of the tube axis Z when the holder 13 is attached to the cathode ray tube) and also are provided on both sides with respect to the tube axis Z along a horizontal axis X. As shown in FIG. 3, a ferrite member 15 for correcting misconvergence XH and YV is held in the housing portion 14.

Figure 1A:
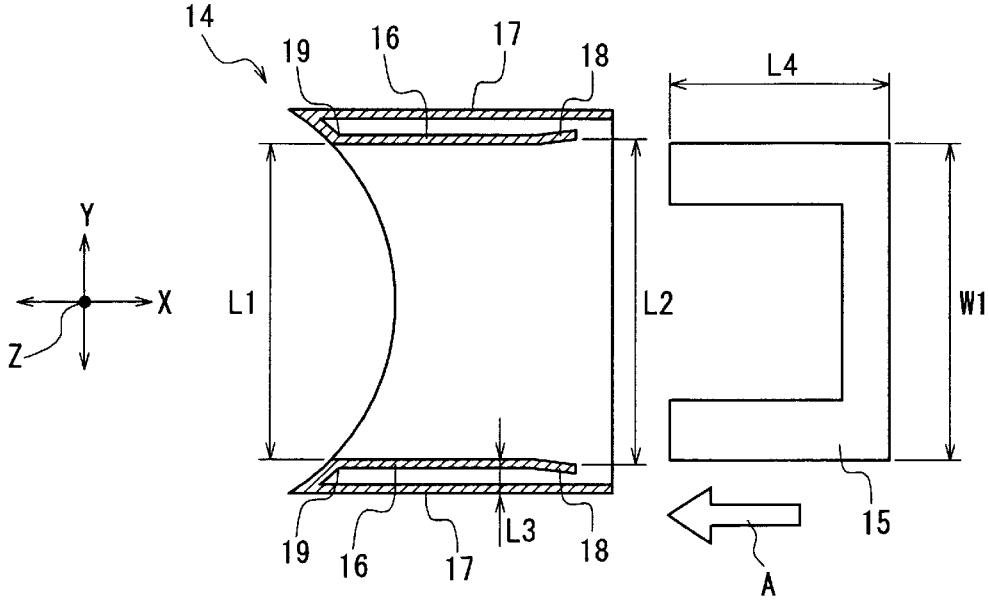
FIG. 1A is a partially sectional view of a housing portion of a holder and a view of a ferrite member of an embodiment according to the present invention.

The housing portion and the ferrite member characterizing the present invention remarkably will be described in more detail with reference to FIGS. 1A to 1C. FIG. 1A is a partially sectional view of the housing portion 14 when viewed from the front part of the deflection yoke. In FIG. 1A, the substantially angular U-shaped ferrite member 15 is moved in a direction indicated by an arrow A and is held in the housing portion 14.

Upper and lower walls of the housing portion 14 have a double structure of inner walls 16 and outer walls 17, and each inner wall 16 is connected to each outer wall 17 at a part close to the tube axis Z. The inner walls 16 are supported in cantilever fashion at the portions where the inner walls 16 are connected to the outer walls 17. The inner walls 16 extend in a direction away from the tube axis Z and slightly bend toward the outer walls 17 in the vicinity of tip portions 18. Consequently, the inner walls 16 function as resilient members and deform resiliently with connection portions 19 (where the inner walls 16 are connected to the outer walls 17) as a fulcrum. The outer walls 17 function as support members for supporting the inner walls 16 when the inner walls 16 deform resiliently. Here, a width W1 of the ferrite member 15 is larger than a distance L1 between the opposed inner walls at the connection portions 19 and is smaller than a distance L2 between the opposed inner walls at the tip portions 18. In the present embodiment, it is assumed that the width W1 of the ferrite member 15 is from 35 mm to 40 mm, the distance L1 between the opposed inner walls at the connection portions 19 is from 34 mm to 39 mm, and the difference between the width W1 and the distance L1 is from 0.5 mm to 1.5 mm. It also is assumed that the distance L2 between the opposed inner walls at the tip portions 18 is from 36 mm to 42 mm, and the difference between the distance L2 and the width W1 is from 0.5 mm to 2.0 mm. Further, it is assumed that a length L4 of the ferrite member 15 is from 24 mm to 29 mm, and a distance L3 between the inner walls 16 and the outer walls 17 is from 2 mm to 3 mm.

Figure 1B:
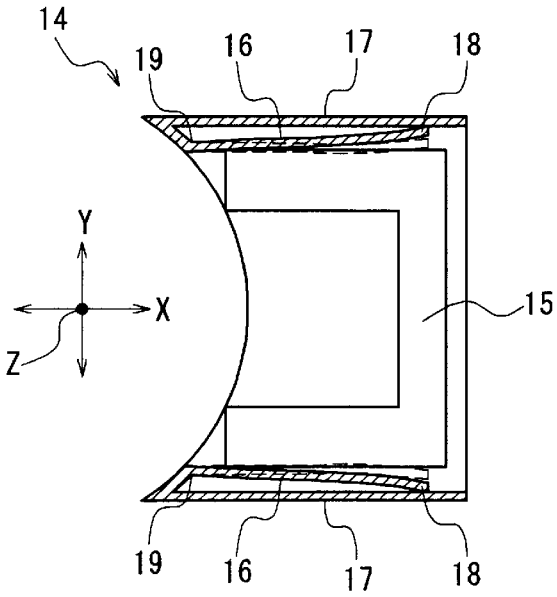
FIG. 1B is a partially sectional view showing a state in which the ferrite member is inserted into the housing portion of the holder of an embodiment according to the present invention.

When the ferrite member is inserted into the housing portion, as shown in FIG. 1B, the inner walls 16 are pressed by the ferrite member 15 to deform resiliently from a state indicated by broken lines to a state indicated by solid lines. At this time, the inner walls 16 sandwich the ferrite member 15 at parts close to the connection portions 19. The tip portions 18 may contact the outer walls 17 as the support members to be supported to secure strength. As a result, the ferrite member 15 can be held firmly. This prevents undesired displacement of the ferrite member 15 both in the direction of the horizontal axis X and a direction of a vertical axis Y of the cathode ray tube apparatus, which is caused by a variation in dimension of the ferrite member and the like. Since the inner walls 16 deform resiliently, correction of the misconvergence XH and YV can be controlled further finely by sliding the ferrite member 15.

Figure 1C:
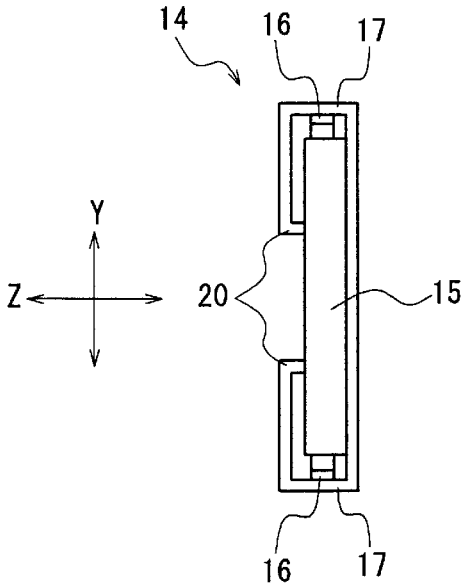
FIG. 1C is a side view showing a state in which the ferrite member is inserted into the housing portion of the holder of an embodiment according to the present invention.

As illustrated in FIG. 1C showing the housing portion seen in the direction of the horizontal axis X of the cathode ray tube apparatus, the housing portion 14 has bent portions 20, and the ferrite member 15 is pressed on a side surface thereof with resiliency. Accordingly, displacement of the ferrite member 15 in the direction of the tube axis Z as well as in the direction of the horizontal axis X and the direction of the vertical axis Y of the cathode ray tube apparatus can be prevented.

As described above, irrespective of a variation in dimension of the ferrite member as a magnetic field correction member, the ferrite member can be held securely at the desired position of the deflection yoke without specially using another member for wrapping the ferrite member. As a result, convergence is improved and the cathode ray tube has an excellent image quality and color purity with a simple construction.

Figure 4:
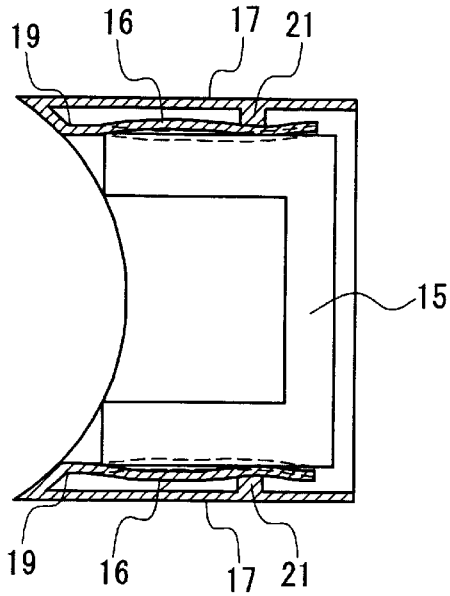
FIG. 4 is a partially sectional view showing a state in which the ferrite member is inserted into a housing portion having projections in another embodiment according to the present invention.

As shown in FIG. 4, the outer walls 17 of the housing portion may have projections 21 facing inwardly. In this case, when the ferrite member 15 is inserted into the housing portion, the inner walls 16 deform resiliently from a state indicated by broken lines to a state indicated by solid lines. The inner walls 16 sandwich the ferrite member 15 at the parts close to the connection portions 19 and at parts close to the projections 21 and are contacted with the projections 21 of the outer walls 17 in order to secure strength. That is to say, the outer walls 17 and the projections 21 function as support members for supporting the inner walls 16 as the resilient members. Because of this construction, the ferrite member 15 can be held firmly at the desired position, so that undesired displacement of the ferrite member 15 both in the direction of the horizontal axis X and the direction of the vertical axis Y of the cathode ray tube apparatus, which is caused by a variation in dimension of the ferrite member and the like, can be prevented.

Although a substantially angular U-shaped ferrite member is shown as a magnetic field correction part in the present embodiment, the present invention is not limited thereto. An I-shaped or L-shaped ferrite member may be used as the magnetic field correction part. In place of a ferrite member, a member made of magnetic alloy and the like may be used.

Figure 5:
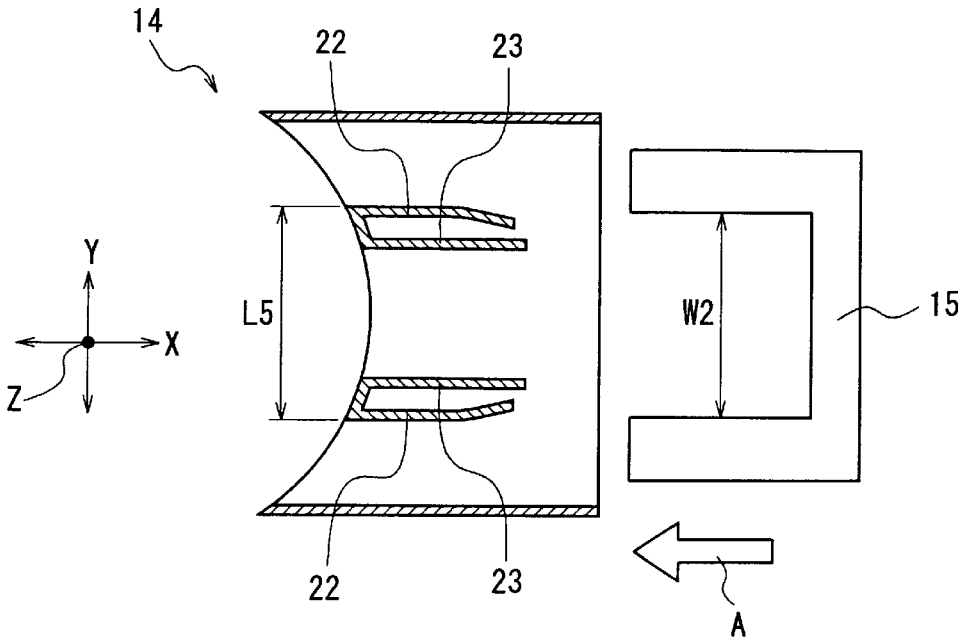
FIG. 5 is a partially sectional view showing an example in which resilient members are provided on an inner side of the housing portion in still another embodiment according to the present invention.
Figure 6:
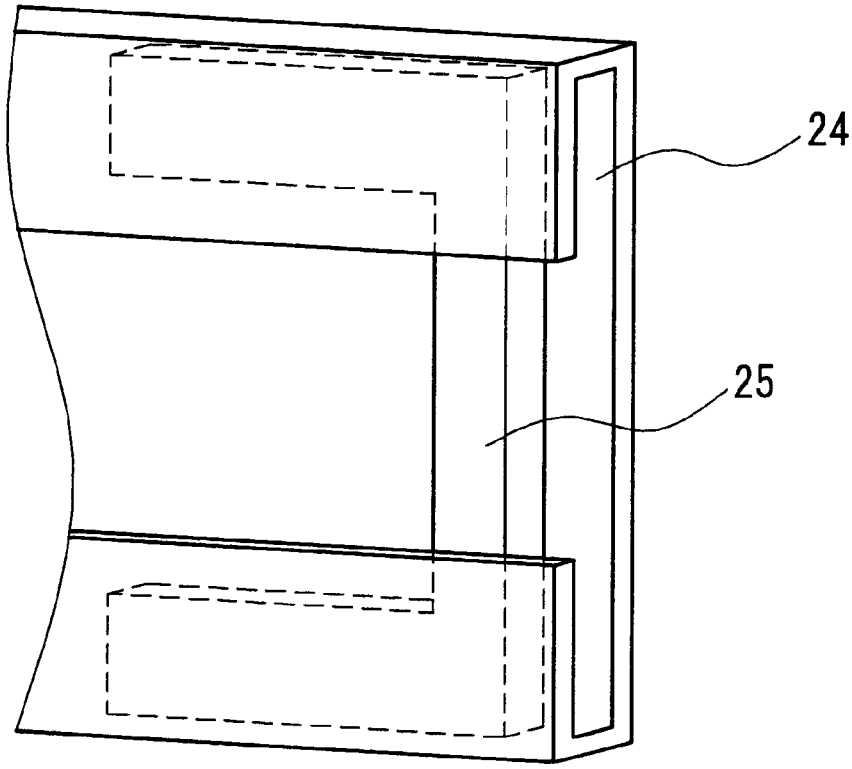
FIG. 6 (PRIOR ART)
FIG. 6 is a partially perspective view showing a state in which a ferrite member is inserted into a conventional holder member.

In the above-described embodiment, the housing portion holds the ferrite member on outer sides thereof. This invention is not limited thereto, but the housing portion may support the ferrite member on the inner sides thereof. As shown in FIG. 5, in this case, the substantially angular U-shaped ferrite member 15 is moved in a direction indicated by an arrow A and is held in the housing portion 14. The housing portion 14 includes resilient members 22 and support members 23. The resilient members 22 hold the ferrite member 15 on the inner sides thereof, and the support members 23 are connected to the resilient members 22 at parts close to the tube axis Z in order to support the resilient members 22 in cantilever fashion. The support members 23 further support the resiliently deformed resilient members 22 while holding the ferrite member 15. Here, it is preferable that a width W2 between inner sides of the ferrite member 15 is smaller than the largest distance L5 between outer sides of the two resilient members 22.

In the above embodiment described by using FIGS. 1, 4, and 5, the resilient members of the housing portion are connected to the support members at the parts thereof close to the tube axis Z. However, this invention is not limited thereto, but the resilient members may be completely independent of the support members. When the resilient members used alone have sufficient mechanical strength to hold the magnetic field correction part and resiliency enough to permit sliding of the magnetic field correction part, the support members may be omitted.

A material for the above-described resilient member in the present invention is not limited particularly, so far as the above function thereof is performed. For example, polypropylene (e.g., 2854 and 2527 manufactured by Chisso Corporation) or modified polyphenylene ether (Noryl: PX9406 and N300 manufactured by General Electric Company and XYRON540Z and XYRON340Z manufactured by Asahi Chemical Industry) can be used as the material.

The invention may be embodied in other forms without departing from the spirit or essential characteristics thereof.

The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube apparatus comprising:

a cathode ray tube comprising an envelope composed of a panel and a funnel; and a deflection yoke arranged on an outer part of the funnel of the cathode ray tube and having a vertical deflection coil and a horizontal deflection coil for generating a main magnetic field, the deflection yoke further comprising a holder for housing a magnetic field correction part for varying the main magnetic field, the holder comprising a resilient member supported in a cantilever fashion, wherein the magnetic field correction part is fixed and held by the resilient member.

2. The cathode ray tube apparatus according to claim 1, wherein the holder comprises a support member for supporting the resilient member.

* * * * *